US010942015B2

(12) United States Patent
Quertelet et al.

(10) Patent No.: US 10,942,015 B2
(45) Date of Patent: Mar. 9, 2021

(54) ACTUATION DEVICE FOR EJECTING AT LEAST ONE REMOVABLE PART OF A MISSILE, PARTICULARLY A NOSE

(71) Applicant: MBDA FRANCE, Le Plessis Robinson (FR)

(72) Inventors: Clément Quertelet, Le Plessis Robinson (FR); Clyde Laheyne, Le Plessis Robinson (FR)

(73) Assignee: MBDA FRANCE, Le Plessis Robinson (FR)

( * ) Notice: Subject to any disclaimer, the term of this patent is extended or adjusted under 35 U.S.C. 154(b) by 0 days.

(21) Appl. No.: 16/500,486

(22) PCT Filed: Apr. 10, 2018

(86) PCT No.: PCT/FR2018/000078
§ 371 (c)(1),
(2) Date: Oct. 3, 2019

(87) PCT Pub. No.: WO2018/197760
PCT Pub. Date: Nov. 1, 2018

(65) Prior Publication Data

US 2020/0109929 A1 Apr. 9, 2020

(30) Foreign Application Priority Data

Apr. 28, 2017 (FR) ..... 1700467

(51) Int. Cl.
*F42B 15/36* (2006.01)
*F42B 15/34* (2006.01)

(52) U.S. Cl.
CPC ..... *F42B 15/36* (2013.01); *F42B 15/34* (2013.01)

(58) Field of Classification Search
CPC ..... F42B 10/46; F42B 10/52; F42B 15/36
(Continued)

(56) References Cited

U.S. PATENT DOCUMENTS 5,235,128 A * 8/1993 Hardesty ..... F42B 15/36 102/351
9,891,031 B2 2/2018 Quertelet
(Continued)

FOREIGN PATENT DOCUMENTS

EP 1 685 362 A2 8/2006
EP 2 960 619 A1 12/2015
(Continued)

OTHER PUBLICATIONS

Written Opinion of the International Searching Authority dated Jun. 15, 2018, issued in corresponding International Application No. PCT/FR2018/000078, filed Apr. 10, 2018, 4 pages.
(Continued)

*Primary Examiner* — Bret Hayes
(74) *Attorney, Agent, or Firm* — Christensen O'Connor Johnson Kindness PLLC

(57) ABSTRACT

An actuation device for ejecting a removable part of a missile includes a pyrotechnic actuator having a pyrotechnic charge configured to generate an overpressure and a piston configured to act on the removable part of the missile, at least one retaining rod, and at least one thermal insulation element configured to thermally insulate at least the pyrotechnic charge. The pyrotechnic actuator is configured to break the retaining rod.

15 Claims, 3 Drawing Sheets

(58) Field of Classification Search
USPC ..... 102/378
See application file for complete search history.

(56) References Cited

U.S. PATENT DOCUMENTS

| | | | | |
|---|---|---|---|---|
| 2005/0000383 | A1* | 1/2005 | Facciano | F42B 10/46 102/377 |
| 2007/0074636 | A1* | 4/2007 | Rieger | F42B 15/36 102/378 |
| 2011/0036261 | A1* | 2/2011 | Krisher | F42B 15/36 102/378 |
| 2013/0264425 | A1* | 10/2013 | Cohe | B64C 1/38 244/130 |

FOREIGN PATENT DOCUMENTS

| | | | |
|---|---|---|---|
| WO | 2005/103600 | A2 | 11/2005 |
| WO | 2009095910 | A2 | 8/2009 |

OTHER PUBLICATIONS

International Preliminary Report on Patentability dated Oct. 29, 2019, issued in corresponding International Application No. PCT/FR2018/000078, filed Apr. 10, 2018, 1 page.
International Search Report dated Jun. 15, 2018, issued in corresponding International Application No. PCT/FR2018/000078, filed Apr. 10, 2018, 5 pages.
Written Opinion of the International Searching Authority dated Jun. 15, 2018, issued in corresponding International Application No. PCT/FR2018/000078, filed Apr. 10, 2018, 5 pages.

* cited by examiner

ACTUATION DEVICE FOR EJECTING AT LEAST ONE REMOVABLE PART OF A MISSILE, PARTICULARLY A NOSE

TECHNICAL FIELD

The present invention concerns an actuation device making it possible to eject at least one removable part of a missile, and a missile provided with at least one such actuation device.

STATE OF THE ART

Although not exclusively, the present invention can be applied to a missile comprising at least one droppable propellant stage and one terminal vehicle which is arranged at the front of the propellant stage. Such a terminal vehicle generally comprises, in particular, a sensor for example forming part of a homing head and likely to be temperature-sensitive.

More specifically, the present invention can be applied to a missile presenting a flying area remaining in the atmosphere and which has kinematic performance such as the terminal vehicle can be brought to hypersonic speeds. At these high speeds, the surface temperature of the missile can reach several hundred degrees Celsius under the effect of the aerothermal flow, which can be detrimental for the holding and the performance of the structures, electronic equipment and present sensors. Also, a (protective) nose, generally comprising several individual shells, is arranged at the front of the missile, so as to thermally and mechanically protect the terminal vehicle during the flight phase of the missile. The nose is then ejected at the suitable time to make it possible, in particular, to use the sensor arranged on the terminal vehicle, during the terminal phase of the flight.

The ejection of the nose is implemented by an actuation device configured to generate a sufficient force to separate the individual shells in a very short time in order to make the sensor quickly operational and to avoid any impeding of the performance of the missile during the ejection phase of the nose. In addition, the actuation device must consider the thermal and mechanical stresses to which the individual shells are subjected before the terminal phase of the flight.

A solution could consist of using a pyrotechnic actuator such as a pyrotechnic ejector bolt, to generate the force necessary to separate the individual shells in very short times. However, the temperatures of several hundred degrees Celsius to which the individual shells are subjected, risk degrading the functioning of the pyrotechnic actuator secured to these, even trigger it unintentionally. Furthermore, the products ejected and the blast effect of the pyrotechnic reaction are likely to damage the sensor of the terminal vehicle or to encumber its measuring capacity by depositing powder residues, for example. This solution is therefore not applicable.

SUMMARY OF THE INVENTION

The present invention aims to overcome these disadvantages. It relates to an actuation device making it possible to eject at least one removable part of a missile, in particular at least one individual shell of a nose.

According to the invention, said actuation device is a one-piece assembly comprising:

a pyrotechnic actuator comprising a activatable pyrotechnic charge able to generate an overpressure and a piston configured to be moved in a longitudinal direction under the effect of the overpressure generated on the head of said piston by the pyrotechnic charge, such that an end of the piston opposite the head of said piston, called free end, is intended to act on said removable part of the missile, at least one retaining rod, at least one thermal insulation element arranged so as to thermally insulate at least the pyrotechnic charge.

In addition, according to the invention, said pyrotechnic actuator is configured to be able to generate a force able to break said at least one retaining rod.

Furthermore, according to the invention, a first end of said at least one retaining rod and an end of said pyrotechnic actuator are intended to be secured to an element of the missile and a second end, opposite said first end of said at least one retaining rod, is intended to be secured to said removable part of the missile.

Thus, thanks to the invention, an actuation device intended to eject a removable missile part is provided, such as an individual shell of a nose, which comprises a pyrotechnic actuator whose functioning is made compatible with the thermal and mechanical stresses of the missile by the arrangement of at least one thermal insulation element and at least one retaining rod. Indeed, the pyrotechnic charge, which is an element of the pyrotechnic actuator sensitive to high temperatures to which the individual shells are subjected, is insulated from the thermal flows in the nose by the arrangement of at least one thermal insulation element. In addition to preventing a degradation of the functioning of the pyrotechnic actuator, even its unintentional triggering, this localised thermal protection makes it possible to minimise the mass and the volume of the embedded actuation device.

Furthermore, the actuation device according to the invention guarantees a mechanical holding during the flight phase. The pyrotechnic actuator only being secured to the removable part, preferably a nose shell, by one of its ends, the actuation device is provided with one or more retaining rods which ensure the mechanical connection between this removable part and a securing element, for example, two individual shells of a nose.

Advantageously arranged on either side of the piston, in a same plane, and substantially parallel to one another and with the movement axis of the piston, these retaining rods are configured to support, in particular the mechanical stresses of the nose during the flight phase preceding the ejection of the nose. In addition, these retaining rods comprise at least one part secured to said pyrotechnic actuator by way of a mechanical covering, which ensures, for example, a better stability of the device faced with mechanical stresses during the flight phase of the missile and ejection of the nose.

In a preferred embodiment, said at least one retaining rod has a weakening zone, which is located preferably in the proximity of the free end of the piston. Thus, when the pyrotechnic actuator is triggered by activation of the pyrotechnic charge, it generates a reduced, but sufficient force to separate the individual shells from one another. The retaining rod, which ensures the connection between the individual shells, is broken into two parts at the level of the weakening zone without producing debris likely to damage the performance of the missile.

In addition, said at least one retaining rod is provided with at least one retaining element, located at the level of the mechanical covering. This retaining element is advantageously arranged to prevent any translation movement of said at least one retaining rod with respect to the pyrotechnic actuator.

Moreover, advantageously, said at least one retaining rod is provided with at least one thermal insulation sleeve, at least one a section of the latter. Said at least one thermal insulation sleeve is located preferably at the level of the mechanical covering. The advantageous arrangement of said at least one sleeve contributes to the thermal insulation of said pyrotechnic actuator.

Furthermore, advantageously, said thermal insulation elements can be made of a mica, mullite, or muscovite type material.

Moreover, the second end of said retaining rod is advantageously provided with a threading, arranged to make it possible to secure said retaining rod to a solid element of the removable part of the missile by way of a nut.

The present invention also concerns a missile which is provided with an actuation device such as that described above, said actuation device being secured by a first end to an element for securing a first part of the missile, for example, an individual shell of a nose or a secured element of the structure of the missile and by a second end, opposite the first end, to an element for securing a removable part of the missile.

In the scope of the present invention, this removable part can correspond to any element having to be ejected from the missile during its flight, and preferably to an individual shell of a nose.

In a preferred embodiment, said missile is provided with a nose comprising at least two individual shells, said first part represents one of said individual shells and said second removable part represents the other individual shell. Advantageously, the actuation device is configured to separate and spread out simultaneously the two individual shells in order to eject them from the missile.

In addition, at least one thermal insulation element is advantageously secured to an element for securing at least one of said removable parts of the missile and arranged facing the free end of said piston.

BRIEF DESCRIPTION OF THE DRAWINGS

The appended figures will make well understandable how the invention can be achieved. In these figures, identical references designate similar elements.

DETAILED DESCRIPTION

Figure 1:
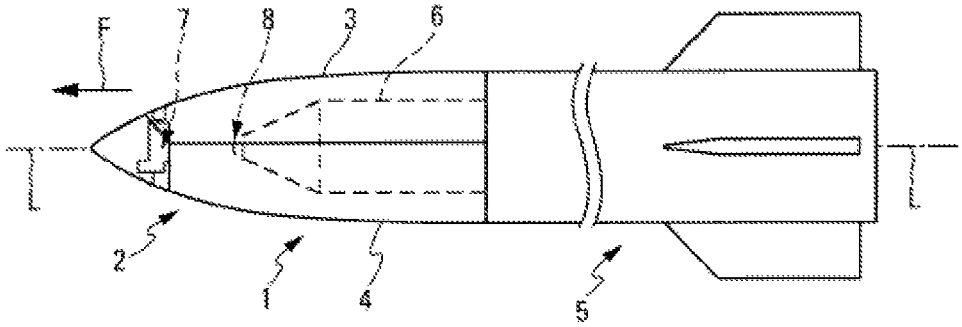
FIGS. 1 and 2 schematically show an example of a missile with a nose, respectively, during the flight phase and during the ejection phase.
Figure 2:
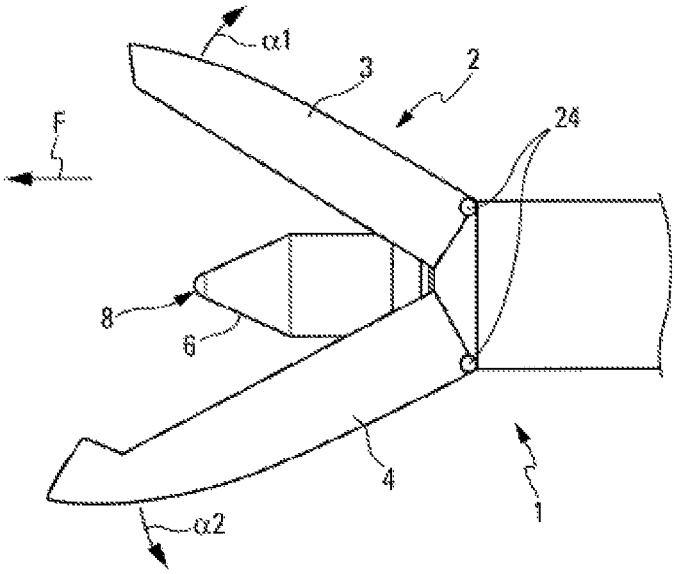

The present invention is applied to a missile 1 represented schematically in FIGS. 1 and 2, which is provided at the front (in the movement direction F of said missile 1) of a (protective) nose 2 comprising several removable parts, in this case, a plurality of shells 3, 4. The present invention concerns an actuation device 7 for the ejection of the nose 2. However, the present invention can be applied to any type of missile 1 comprising at least one removable part to be being ejected.

As represented in FIGS. 1 and 2, the missile 1 of longitudinal axis L-L, comprises at least one droppable propellant stage 5 and one terminal vehicle 6 which is arranged before this propellant stage 5.

Generally, such a flying terminal vehicle 6 comprises, in particular, at least one sensor 8 arranged upstream, for example forming part of a homing head and likely to be temperature-sensitive. The propellent stage 5 and the terminal vehicle 6 which can be of any usual type, are not further described in the following description.

Usually, the propellent stage or stages 5 of such a missile 1 are intended for the propulsion of said missile 1, from the firing until the approach of a target (having to be neutralised by the missile 1). The terminal phase of the flight is, itself, carried out autonomously by the terminal vehicle 6, which in particular uses the information coming from the embedded sensor 8, for example an optoelectronic sensor intended to assist the detection of the target. To do this, the terminal vehicle 6 comprises all the usual means (not further described), which are necessary to achieve this terminal flight. Before implementing the terminal phase, the nose 2 is dropped or it all at least open, after a separation of the different shells 3 and 4, by activating the actuation device 7, to release the (flying) terminal vehicle 6 which is then separated from the remainder of the missile 1.

The missile 1 is therefore provided upstream of a separable nose 2 which is intended, in particular, to thermally and mechanically protect the terminal vehicle 6. This nose 2 must however be able to be removed at the suitable time, in particular to make it possible for the use of the sensor 8 placed on the terminal vehicle 6 in the terminal phase of the flight.

In the situation of FIG. 1, the nose 2 is mounted on the missile 1 in a functioning (or protective) position. The terminal vehicle 6 is mounted inside the nose 2 which is represented by dashes.

Figure 3:
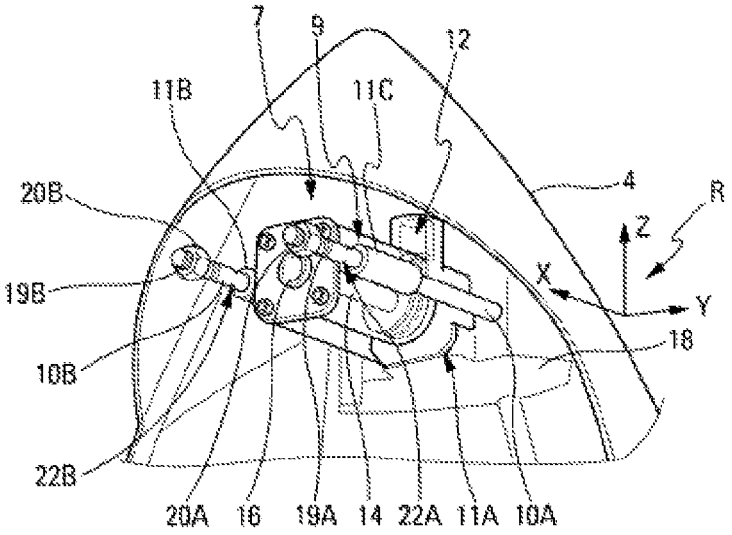
FIG. 3 shows the arrangement of a specific embodiment of an actuation device on one of the individual shells of the nose.

Furthermore, in the situation of FIG. 2, the shells 3 and 4 are being separated, as illustrated respectively by the arrows $\alpha 1$ and $\alpha 2$, during a phase of opening or dropping the nose 2. The releasing of the shells 3 and 4 and the impulse to generate the movements illustrated by the arrows $\alpha 1$ and $\alpha 2$, are created by the actuation device 7 arranged preferably upstream of the nose 2 (inside the latter), as represented in FIGS. 1 and 3. This phase of opening or dropping the nose 2 makes it possible to release the terminal vehicle 6.

Although not exclusively, the present invention can be applied more specifically to a missile 1 presenting a flight area remaining in the atmosphere and which has kinematic performance making it possible to bring the terminal vehicle 6 to hypersonic speeds. At these high speeds, the surface temperature of the missile 1 can reach several hundred degrees Celsius under the effect of the aerothermal flow, which requires providing an effective nose 2 to make it possible for the stability and the performance of the structures, electronic equipment and embedded sensors. However, the present invention can be applied to a missile 1 evolving in any case, from the flight area (in and outside of the atmosphere) and for speeds going from the subsonic to the high supersonic/hypersonic.

By referring to FIGS. 1 and 3, the actuation device 7 making it possible to eject the shells 3 and 4 from the missile 1 is arranged upstream of the nose 2, between the shells 3 and 4, in a plane transversal to the longitudinal axis L-L of the missile 1.

In the description below, a marker R is used, associated with the pyrotechnic actuation device 7 and defined according to three orthogonal axes, namely an axis called longitudinal X which is oriented according to the actuation device 7 which is extended, and two axes Y and Z which define a median plane XY and a transverse plane YZ. The axis Z corresponds to the longitudinal axis L-L of the missile 1. In addition, the adverbs front and rear are defined with respect to the movement direction of the piston 14, which is represented by the arrow G and described below.

Figure 4:
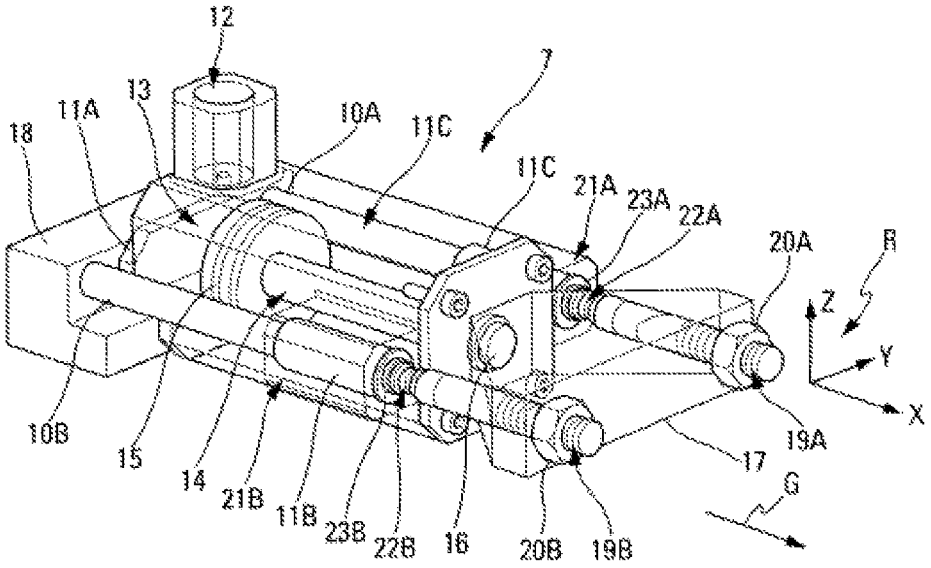
FIGS. 4 and 5 are schematic, respectively perspective, and median cross-sectional views of the actuation device.
Figure 5:
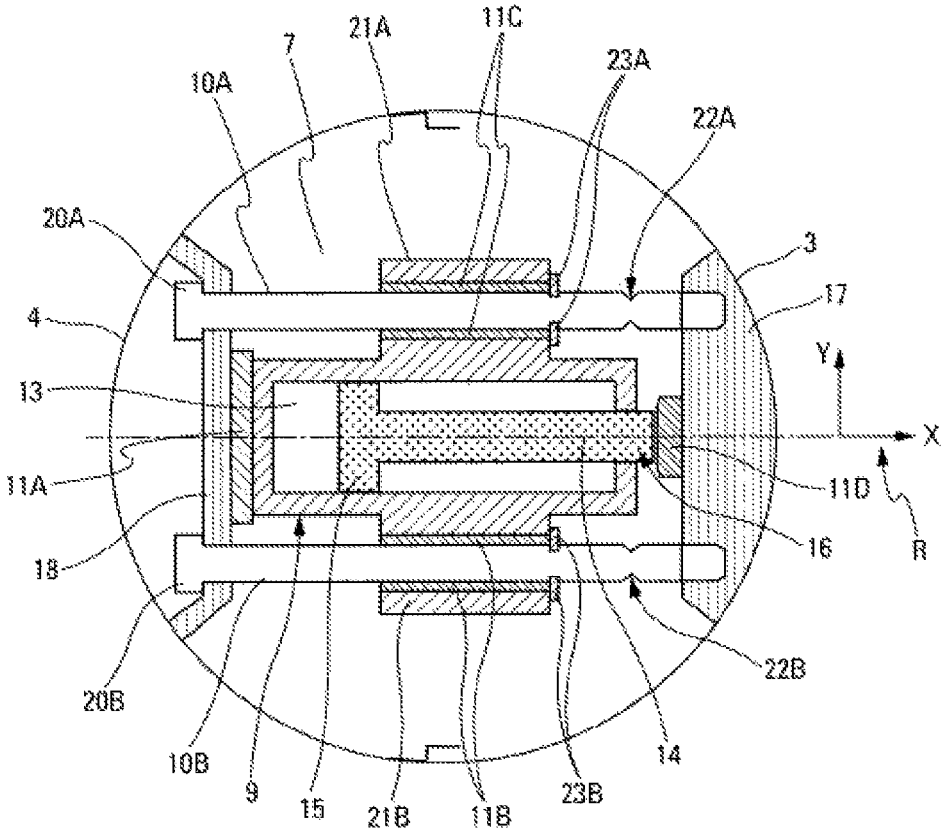

As represented in FIGS. 3, 4 and 5, the actuation device 7, according to the invention, is a one-piece assembly comprising:

a pyrotechnic actuator 9 arranged according to the longitudinal axis X, two retaining rods 10A and 10B, substantially parallel to one another and with the longitudinal axis X and arranged on either side of the pyrotechnic actuator 9, in the median plane XY, and at least one, but preferably a plurality of thermal insulation elements 11A, 11B, 110 and 11D arranged so as to locally insulate the pyrotechnic actuator 9.

In a preferred embodiment, represented in FIGS. 4 and 5, the pyrotechnic actuator 9 comprises an activatable pyrotechnic charge 12, a combustion chamber 13 arranged to the rear of the pyrotechnic actuator 9 in the same transverse plane YZ as the pyrotechnic charge 12, and a piston 14 arranged along the longitudinal axis X, of which the head 15 is in the extension of the combustion chamber 13. The pyrotechnic actuator 9 is triggered by the activation of the pyrotechnic charge 12, which is achieved usually, by an order given automatically by a control unit (not represented) of the missile 1. When the pyrotechnic charge 12 is activated, it produces an overpressure in the combustion chamber 13 which generates the movement of the piston 14 in the direction of the arrow G. The piston 14 is moved to one of its ends, opposite the head 15 of the piston, called free end 16, presses against a securing element 17 which is secured to the shell 3.

The pyrotechnic actuator 9 can, for example, be a pyrotechnic cylinder configured to contain powder debris and residues of the pyrotechnic reaction which are likely to damage the sensor 8 of the terminal vehicle 6 or encumber its measuring capacity.

In the embodiment represented by FIGS. 4 and 5, the pyrotechnic actuator 9 is secured by a first end, located to the rear of the pyrotechnic device 7, to a securing element 18 which is secured to the shell 4. A second end of the pyrotechnic actuator 9, opposite said first end, is free.

The retaining rods 10A and 10B also comprise a first end located at the rear of the pyrotechnic device 7 and a second end located at the front of the pyrotechnic device 7. Each retaining rod 10A, 10B is secured, as specified below, by its first end to the securing element 17 of the shell 3 and by its second end to the securing element 18 of the shell 4. The retaining rods 10A and 10B ensure the mechanical connection between the shells 3 and 4 of the nose 2, in particular during the flight phase of the missile 1.

In a specific embodiment, one of the two ends of each of the retaining rods 10A and 10B is provided with a threading 19A, 19B which makes it possible to screw the retaining rods 10A and 10B to the securing element 17, 18 by way of a nut 20A, 20B. The position of the nut 20A, 20B along the threading determines the screwing of the retaining rods 10A and 10B in one of the securing elements 17, 18 of one of the shells 3, 4, which fixes the force that the shells 3 and 4 exert on one another during the flight phase of the missile 1. This force is called mechanical prestress.

In addition, the retaining rods 10A and 10B are connected to the pyrotechnic actuator 9 by way of mechanical coverings 21A, 21B. As represented in FIGS. 4 and 5, the mechanical covering 21A and 21B are secured on either side of the pyrotechnic actuator 9, at the level of the body of the piston 14 in the mounting position, and surround a section of the retaining rods 10A and 10B. In a specific embodiment, the mechanical coverings 21A and 21B can correspond to lateral extensions of the pyrotechnic actuator 9.

Furthermore, each retaining rod 10A, 10B is provided with a weakening zone 22A, 22B located, preferably, in the same transverse plane YZ as the free end 16 of the piston 14 in the mounting position, between the securing element 17 and the mechanical covering 19A, 19B. Each of the weakening zones 22A and 22B corresponds to a circular recess on a longitudinal part of the retaining rods 10A and 10B, which reduces their mechanical resistance. Thus, under the effect of the force generated by the pyrotechnic actuator 9, the retaining rods 10A and 10B are broken at the level of the weakening zones 22A and 22B.

As represented in FIG. 5, a retaining element 23A, 23B, for example, a pin or a collar, is arranged around the retaining rod 10A, 10B, against the end of the mechanical covering 21A, 21B closest to the weakening zone 22A, 22B. This retaining element 23A, 23B retains the retaining rod 10A, 10B in the mechanical covering 21A, 22B in the longitudinal direction X.

Several thermal insulation elements 11A, 11B, 110, 11D are arranged on parts of the pyrotechnic actuator 9 in order to insulate the heat flows to which the shells 3 and 4 of the nose 2 are subjected during the flight phase.

Thus, a thermal insulation element 11A is located between the element for securing 18 the shell 4 and the pyrotechnic charge 12 to avoid the heat of the shell 4 being transmitted to the pyrotechnic charge 12 and unintentionally triggers the pyrotechnic actuator 9. Two other thermal insulation elements are arranged, in the form of sleeves 11B and 110, around the sections of the retaining rods 10A and 10B which pass through the mechanical coverings 21A and 21B to avoid the heat flows circulating between the shells 3 and 4 by way of the retaining rods 10A and 10B do not pass the pyrotechnic actuator 9. Furthermore, a thermal insulation element 11D can be arranged facing the free end 16 of the piston 14, and secured to the element for securing 17 the shell 3 of the missile 1.

In a specific embodiment, the thermal insulation elements 11A, 11B, 110, 11D protect the pyrotechnic actuator 9 by only insulating the pyrotechnic charge 12.

In a preferred embodiment, the thermal insulation elements 11A, 11B, 110 and 11D are made of one of the following materials: mica, mullite, muscovite. These materials, while being excellent thermal insulators, have a sufficient hardness to not absorb the force generated by the pyrotechnic actuator 9 in order to separate the shells 3 and 4.

The functioning mode of the actuation device, such as described above, is as follows.

During the flight phase of the missile 1, the nose 2 is held closed by way of retaining rods 10A and 10B which are secured by their ends to securing elements 17 and 18 of the shells 3 and 4. In addition, the stability of the nose 2 depends on the mechanical prestress exerted between the shells 3 and 4. This mechanical prestress is controlled by the retaining rods 10A and 10B by adjusting the position of the nut 20A, 20B along the threading of one of the ends of the retaining rods 10A and 10B. Furthermore, the nose 2 undergoes high thermal stresses during the flight phase. These thermal flows circulate between the shells 3 and 4, in particular by way of the retaining rods 10A and 10B which create a thermal bridge between the securing elements 17 and 18 of the shells 3 and 4. To avoid any unintentional triggering of the pyrotechnic actuator 9, the thermal insulation elements 11A, 11B, 110, 11D are arranged appropriately between the pyrotechnic charge 12 and the element for securing 18 the shell 4, as well as between the retaining rods 10A and 10B and the mechanical coverings 21A and 21B.

When the shells 3, 4 of the nose 2 must be separated, a signal activates the pyrotechnic charge 12 of the pyrotechnic actuator 9. Thus, an overpressure is produced in the combustion chamber 13, which generates a thrust force on the piston 14 which is moved in the direction of the arrow G. When the free end 16 of the piston 14 presses against the element for securing 17 the shell 4, the piston 14 transmits the thrust force to the shell 3. Since the pyrotechnic device 7 is secured to the two shells 3 and 4 by way of the retaining rods 10A and 10B, the shell 3 is subjected to an equal thrust force, but in the opposite direction, to that acting on the shell 4. These forces of opposite directions act on the retaining rods 10A and 10B until causing their breaking at the level of the weakening zones 22A and 22B. As the retaining elements 23A and 23B, arranged on the retaining rods 10A and 10B at the level of the mechanical coverings 21A and 21B, block any translational movement of the rods with respect to the pyrotechnic actuator 9, the shells 3 and 4 are separated and are spread out from one another simultaneously by pivoting around rotational elements 24, for example hinges. Thus, this results in the ejection of the shells 3 and 4 from the missile 1.

The actuation device 7, such as described above, is a one-piece assembly, of which the architecture makes it possible to fulfil, on the one hand, the function of maintaining the stability of the nose 2, in particular during the flight phase and, on the other hand, the function of the rapid ejection of the shells 3 and 4. The architecture of the actuation device 7 makes the use of a pyrotechnic actuator 9 capable of generating a significant force in a very short time compatible, despite the high temperatures to which the shells 3 and 4 are subjected. Thus, during the flight phase, the arrangement of the thermal insulation elements 11A, 11B, 11C, 11D, as well as the configuration of the retaining rods 10A and 10B preserve the functioning of the pyrotechnic actuator 9 by insulating it from the thermal and mechanical stresses that the shells 3 and 4 undergo. During the ejection phase, the nose 2 must be ejected very quickly to make it possible to use the sensor 8. The pyrotechnic actuator 9 makes this rapid ejection possible by generating a sufficient force to break the retaining rods 10A and 10B, weakened beforehand. Furthermore, the thermal insulation elements 11A, 11B, 11C, 11D form a localised protection which makes it possible to minimise the mass and the volume of the embedded actuation device 7.

The pyrotechnic actuation device 7 also presents the advantage of being adaptable to the holding and to the ejection of any removable part of the missile 1 in a high-temperature environment. Finally, the actuation device 7 functions, in any case, from the flight area (in and outside of the atmosphere) and for speeds going from the subsonic to the high supersonic/hypersonic.

The invention claimed is:

1. An actuation device configured to eject at least one removable part of a missile, the actuation device comprising:

a pyrotechnic actuator comprising an activatable pyrotechnic charge configured to generate an overpressure, and a piston configured to be moved in a longitudinal direction of the missile by the overpressure generated on a head of said piston by the activatable pyrotechnic charge, such that a free end of the piston opposite said head is configured to act on said removable part of the missile;

at least one retaining rod comprising at least one part secured to said pyrotechnic actuator by a mechanical covering; and at least one thermal insulation element configured to thermally insulate at least the pyrotechnic actuator, wherein said pyrotechnic actuator is configured to break said at least one retaining rod, wherein a first end of said at least one retaining rod and an end of said pyrotechnic actuator are configured to be secured to a first shell securing element of the missile, wherein a second end of the at least one retaining rod, opposite said first end of said at least one retaining rod, is configured to be secured to a second shell securing element of the missile.

2. The actuation device according to claim 1, wherein the at least one retaining rod comprises two retaining rods substantially parallel to one another and with an axis along which the piston is configured to move, the two retaining rods being arranged on either side of said piston in a same plane.

3. The actuation device according to claim 1, wherein said at least one retaining rod has at least one weakening zone.

4. The actuation device according to claim 3, wherein said weakening zone is located in a proximity of the free end of the piston.

5. The actuation device according to claim 1, wherein the at least one retaining rod comprises at least one retaining element with respect to the pyrotechnic actuator.

6. The actuation device according to claim 5, wherein the at least one retaining element is arranged at a level of the mechanical covering.

7. The actuation device according to claim 1, wherein the at least one retaining rod is provided with at least one thermal insulation sleeve.

8. The actuation device according to claim 7, wherein said thermal insulation sleeve is arranged at a level of the mechanical covering.

9. The actuation device according to claim 1, wherein said second end of the at least one retaining rod is provided with a threading configured to secure said at least one retaining rod to the second shell securing element of the missile by way of a nut.

10. The actuation device according to claim 1, wherein said thermal insulation element comprises at least one of the following materials: mica, mullite, or muscovite.

11. A missile comprising the actuation device of claim 1, said actuation device being secured by the first end to the first shell securing element of the missile and by the second end, opposite said first end, to the second shell securing element of the missile.

12. The missile according to claim 11, wherein said first shell securing element secures the actuation device to a first shell of a nose of the missile and said second shell securing element secures the actuation device to a second shell of the nose.

13. The missile according to claim 12, wherein the actuation device is configured to separate and spread out simultaneously the first shell and the second shell of the nose.

14. The missile according to claim 11, wherein the at least one thermal insulation element is arranged facing the free end of said piston, and secured to the second shell securing element of the missile.

15. The actuation device according to claim 1, wherein the at least one retaining rod comprises at least one retaining element configured to prevent translation of said at least one retaining rod with respect to the pyrotechnic actuator.

* * * * *